US005239721A

United States Patent [19]

Zahuranec

[11] Patent Number: 5,239,721

[45] Date of Patent: Aug. 31, 1993

[54] PLANETARY GEAR SYSTEM FOR SWEEPER BRUSH ROLL

[75] Inventor: Terry L. Zahuranec, Hudson, Ohio

[73] Assignee: Royal Appliance Mfg. Co., Cleveland, Ohio

[21] Appl. No.: 903,720

[22] Filed: Jun. 24, 1992

Related U.S. Application Data

[63] Continuation-in-part of Ser. No. 731,537, Jul. 17, 1991, abandoned.

[51] Int. Cl.[5] ..... A47L 11/33; A47L 11/40

[52] U.S. Cl. ..... 15/41.1; 15/79.1; 56/253

[58] Field of Search ..... 15/41.1, 42–45, 15/48, 48.1, 48.2, 79.1; 56/249, 253, 254

[56] References Cited

U.S. PATENT DOCUMENTS

| | | | |
|---|---|---|---|
| 131,726 | 9/1872 | Walker | 56/253 |
| 212,727 | 2/1879 | Moore . | |
| 333,181 | 12/1885 | Waters | 56/253 |
| 507,543 | 10/1893 | Jennings | 56/253 |
| 748,560 | 12/1903 | Reenstierna | 15/41.1 |
| 804,213 | 11/1905 | Chaplin . | |
| 901,978 | 10/1908 | Mally et al. . | |
| 2,286,270 | 6/1942 | Haberstump . | |
| 2,587,083 | 2/1952 | Goodel . | |
| 2,783,487 | 3/1957 | Luders . | |
| 3,074,084 | 1/1963 | Brown, Jr. . | |
| 3,638,267 | 2/1972 | Liebscher . | |
| 4,007,508 | 2/1977 | Ooyachi . | |

FOREIGN PATENT DOCUMENTS

| | | | |
|---|---|---|---|
| 1503837 | 9/1969 | Fed. Rep. of Germany . | |
| 1923908 | 11/1970 | Fed. Rep. of Germany . | |
| 2411486 | 9/1975 | Fed. Rep. of Germany | 15/42 |
| 599633 | 11/1959 | Italy | 15/41.1 |

*Primary Examiner*—Edward L. Roberts

*Attorney, Agent, or Firm*—Fay, Sharpe, Beall, Fagan, Minnich & McKee

[57] ABSTRACT

A floor sweeper includes a housing and wheels rotatably mounted on the housing for supporting the housing on a subjacent surface. A brush roll is rotatably mounted on the housing. A pair of gear cartridge members are located on opposite sides of the housing. Each of the gear cartridge members includes a first planetary gear train including a sun gear coupled to a respective end of the brush roll, a gear ring encircling the sun gear and a plurality of planet gears engaging both the sun gear and gear ring. A first drive wheel is coupled to the gear ring and a casing encloses the first planetary gear train.

20 Claims, 7 Drawing Sheets

PLANETARY GEAR SYSTEM FOR SWEEPER BRUSH ROLL

This application is a continuation-in-part of application Ser. No. 07/731,537 filed on Jul. 17, 1991 now abandoned.

BACKGROUND OF THE INVENTION

The present invention is directed to floor sweepers or carpet sweepers. More specifically, the present invention is directed to a mechanism for rotating the brush roll of such sweepers.

Carpet sweepers in which the brush rotates at a faster rate of speed than the speed of rotation of a traction wheel of the device are known. Such carpet sweepers employ a gear train which is not sealed from the environment and is therefore prone to becoming jammed with dust, pet hairs, and the like. Nor do such carpet sweepers have an epicyclic or planetary gear arrangement which would provide a compact construction. Other carpet sweepers are known which utilize a gear train mechanism having planetary gears for driving a centrally positioned rotating brush. However, these gearing mechanisms are also not sealed from the environment and are thus prone to becoming jammed by the dirt and particles which are swept up by the rotary brush of the carpet sweeper.

A multi-element gear train mechanism interconnecting a pair of driving wheels of a carpet sweeper with a pair of rotary brushes is also known. The brushes are selectively actuated depending on the direction of rotation of the carpet sweeper. This gear train is enclosed in an elongated rectangular housing and includes a plurality of adjacent gears rather than a compact planetary gear construction.

Accordingly, it has been considered desirable to develop a new and improved floor sweeper which would overcome the foregoing difficulties and others while providing better and more advantageous overall results.

BRIEF SUMMARY OF THE INVENTION

In accordance with the present invention, a new and improved floor sweeper is provided.

More particularly in accordance with this aspect of the invention, the floor sweeper comprises a housing and a wheel rotatably mounted on the housing for supporting the housing on a subjacent surface. A brush roll is rotatably mounted on the housing. A gear cartridge member is located on one side of the housing. The gear cartridge member comprises a first planetary gear train including a sun gear coupled to one end of the brush roll, a gear ring encircling the sun gear and a plurality of planet gears engaging both the sun gear and the gear ring. A first drive wheel is coupled to the gear ring for driving the gear ring and supporting the housing on a subjacent surface. A casing encloses the first planetary gear train in a sealed manner.

According to another aspect of the invention, the casing comprises a first casing half including a plurality of stakes which extend from and are normal to a wall of the first casing half to rotatably support one of the planet gears and a second casing half. The casing halves have edges which cooperate to allow the casing halves to be secured together.

In accordance with a still another aspect of the invention, the casing further comprises a rim extending normal to a wall of each casing half with each of the rims cooperating with a groove located on a respective side of the drive wheel to serve as a dust shield for the planetary gear train and to prevent overtravel of the drive wheel in the casing.

According to yet another aspect of the invention, the sweeper further comprises a support means for supporting a second end of the brush roll. The support means is located on an opposite side of the housing from the gear cartridge member. The support means can be another gear cartridge member. Alternatively, the support means can comprise a wheel housing including a support element for rotatably supporting a second end of the brush roll and a support wheel rotatably mounted on the wheel housing.

In accordance with a further aspect of the invention, the gear cartridge member further comprise a second planetary gear train spaced from the first planetary gear train and including a sun gear coupled to a second brush roll, a ring gear encircling the sun gear and a plurality of planet gears engaging the sun gear and the ring gear. A second drive wheel is coupled to the ring gear of the second gear train and the casing encloses the second gear train.

One advantage of the present invention is the provision of a new and improved carpet sweeper.

Another advantage of the present invention is the provision of a carpet sweeper having a gearing system which enables a brush roll to rotate faster than the driving wheels of the carpet sweeper.

Still another advantage of the present invention is the provision of a carpet sweeper in which a gearing system for interconnecting the driving wheel with the brush roll is shielded from dirt and dust.

Yet another advantage of the present invention is the provision of a carpet sweeper in which a gearing system interconnecting a drive wheel and a brush roll is located in an interchangeable cartridge which can be selectively secured in place or removed from the carpet sweeper and replaced with another cartridge when necessary. This enables the operator to substitute a gearing system having a different gear ratio for a faster or slower rotation speed for the brush roll.

Still yet another advantage of the present invention is the provision of a carpet sweeper having a gear cartridge on one end of a rotating brush roll and having a support means for supporting another end of the brush roll. The support means can either be a second gear cartridge or can be simply a wheel housing including a support element for rotatably supporting a second end of the brush roll and a support wheel rotatably mounted on the wheel housing. Therefore, a first end of the brush roll is engaged with the gear housing whereas a second end of the brush roll rotates freely in the support element of the wheel housing.

A further advantage of the present invention is the provision of a compact planetary gearing system for interconnecting the driving wheel of a carpet sweeper with the brush roll. Preferably, the planetary gearing system is located within the driving wheel and is shielded from the environment by a labyrinth seal formed by a pair of housing walls which cooperate with the driving wheel.

A still further advantage of the present invention is the provision of a carpet sweeper in which a gear cartridge can include a pair of spaced planetary gear train assemblies each of which is adapted to rotate a respective brush roll.

A yet further advantage of the present invention is the provision of a carpet sweeper having a gear train which is made from a resilient and flexible material such as plastic.

Still other advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the drawings described below.

DETAILED DESCRIPTION OF THE PREFERRED AND ALTERNATE EMBODIMENTS

Figure 3:
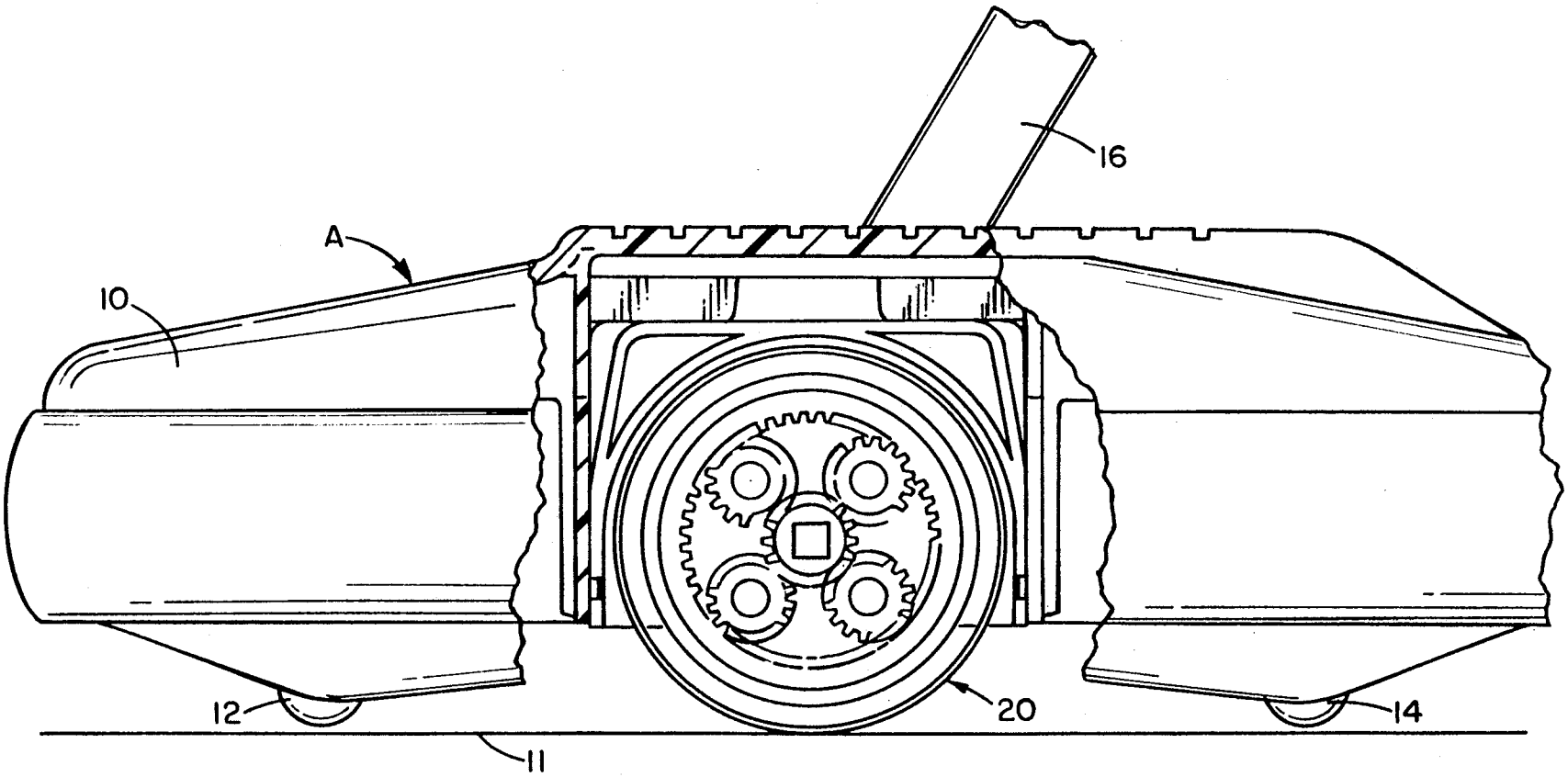
FIG. 3 is a side elevational view, partially in cross-section, of the carpet sweeper of FIG. 2 in an assembled condition.
Figure 6:
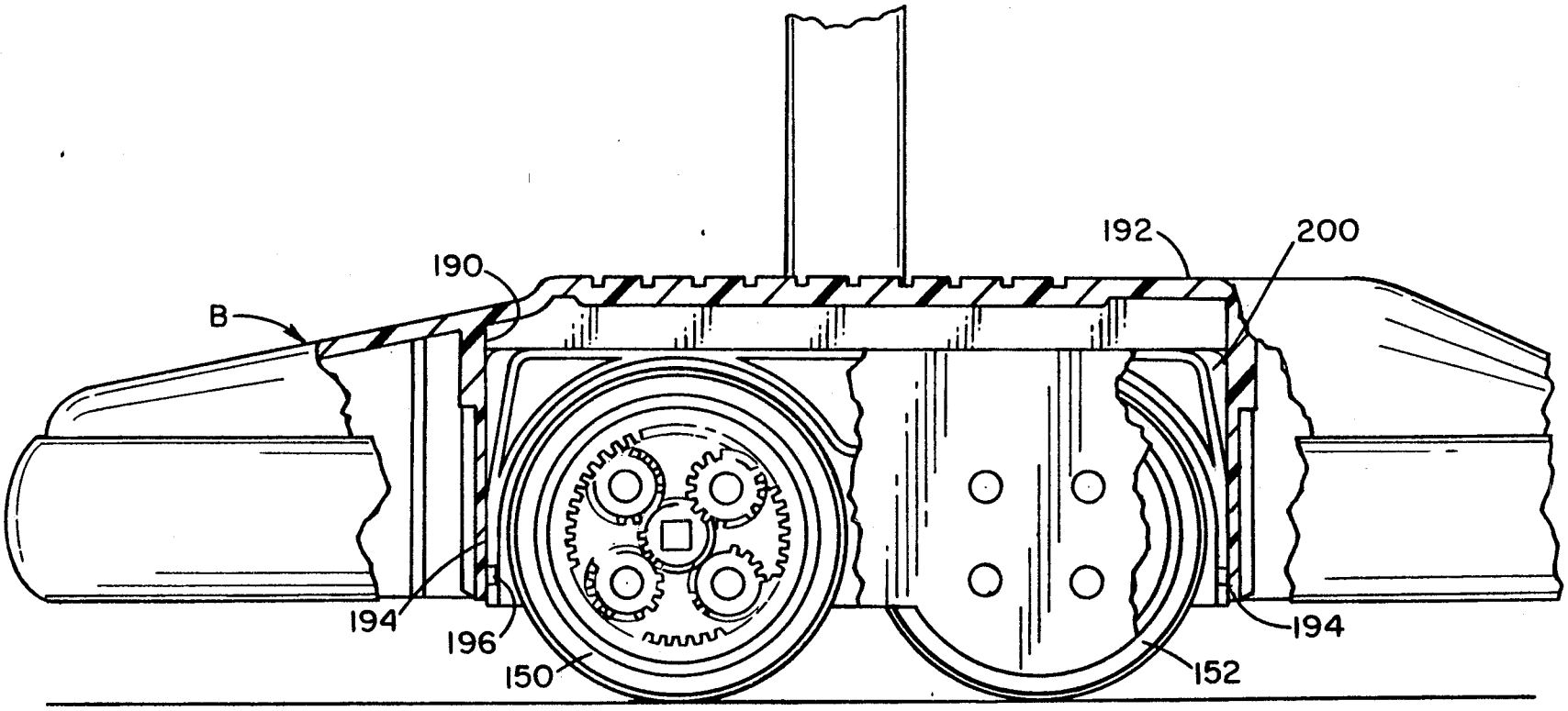
FIG. 6 is a side elevational view of a carpet sweeper according to the second preferred embodiment of the present invention; and, FIG. 7 is an exploded perspective view of a support means for supporting a second end of the brush roll according to an alternate embodiment of the present invention.

Referring now to the drawings, wherein the showings are for purposes of illustrating preferred and alternate embodiments of the invention only and not for purposes of limiting the same, FIG. 3 shows a single brush roll carpet sweeper A and FIG. 6 shows a double brush roll carpet sweeper B having gear cartridges according to the preferred embodiments of the present invention. While the gear cartridges described hereinbelow are particularly adapted for the styles of carpet sweeper illustrated in FIGS. 3 and 6, it should be appreciated that these gear cartridges could also be utilized in many other varieties of floor or carpet sweepers as well as in numerous other environments.

With reference now to the single roll embodiment of FIG. 3, the carpet sweeper A includes a housing 10 which is rotatably supported on a ground surface 11 by front rollers 12 and rear rollers 14. The housing can be moved on the surface through the use of a suitable handle 16.

Figure 2:
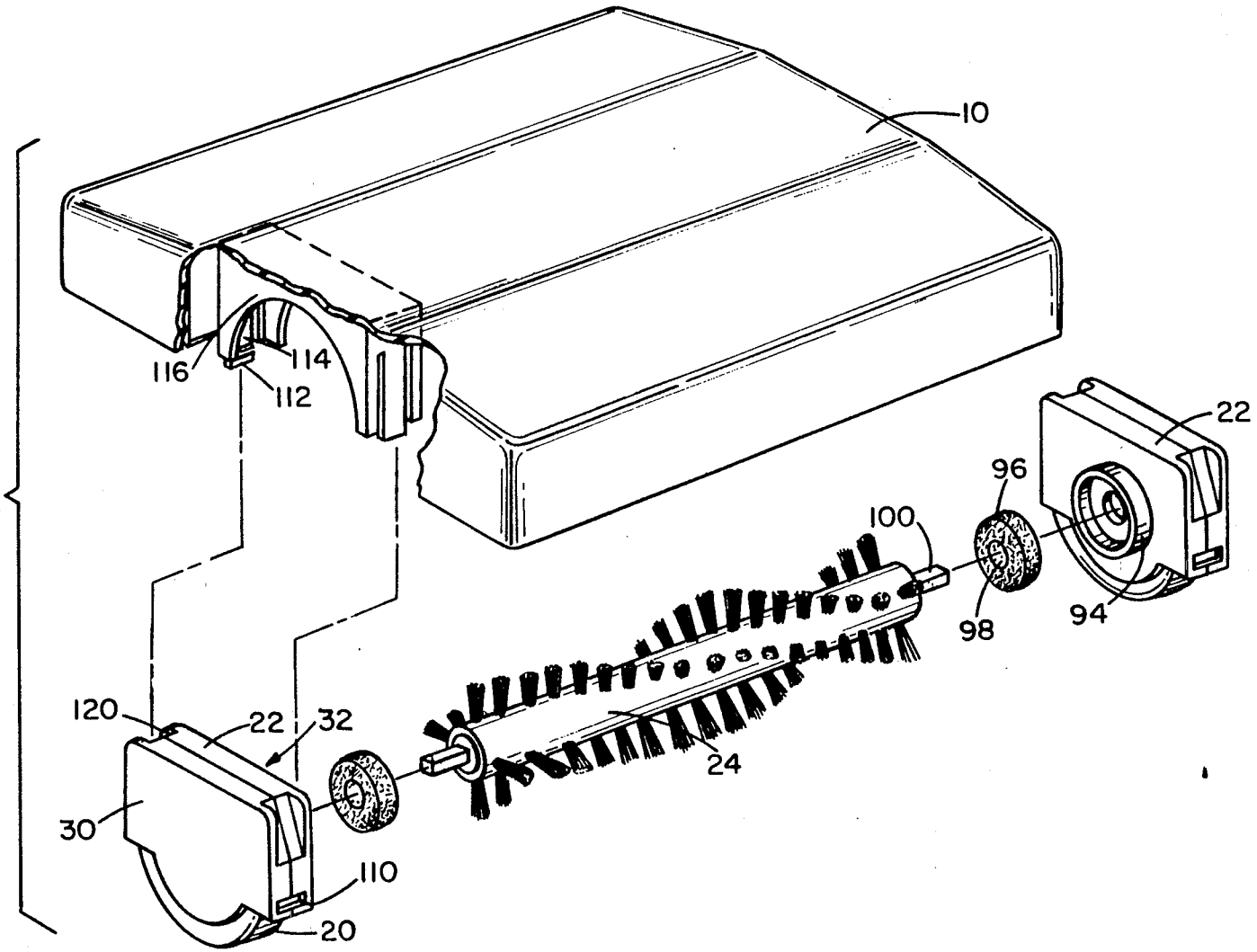
FIG. 2 is an exploded perspective view of a carpet sweeper housing, a pair of gear cartridges and a brush roll adapted to be mounted thereto according to the first preferred embodiment of the present invention.

With reference now also to FIG. 2, a drive wheel 20 also extends from underneath the housing 10 so as to contact the ground support surface 11. The drive wheel 20 is held in a gear cartridge casing 22. As is evident from FIG. 2, two such drive wheels and housings are provided. Interposed between the two casings 22 is a suitable brush roll 24 which is rotatably coupled to the casings as will be explained later. Since the two casings 22 are identical, only the left casing illustrated in FIG. 2 will be described in detail, it being appreciated that the right casing has the identical components.

Figure 1:
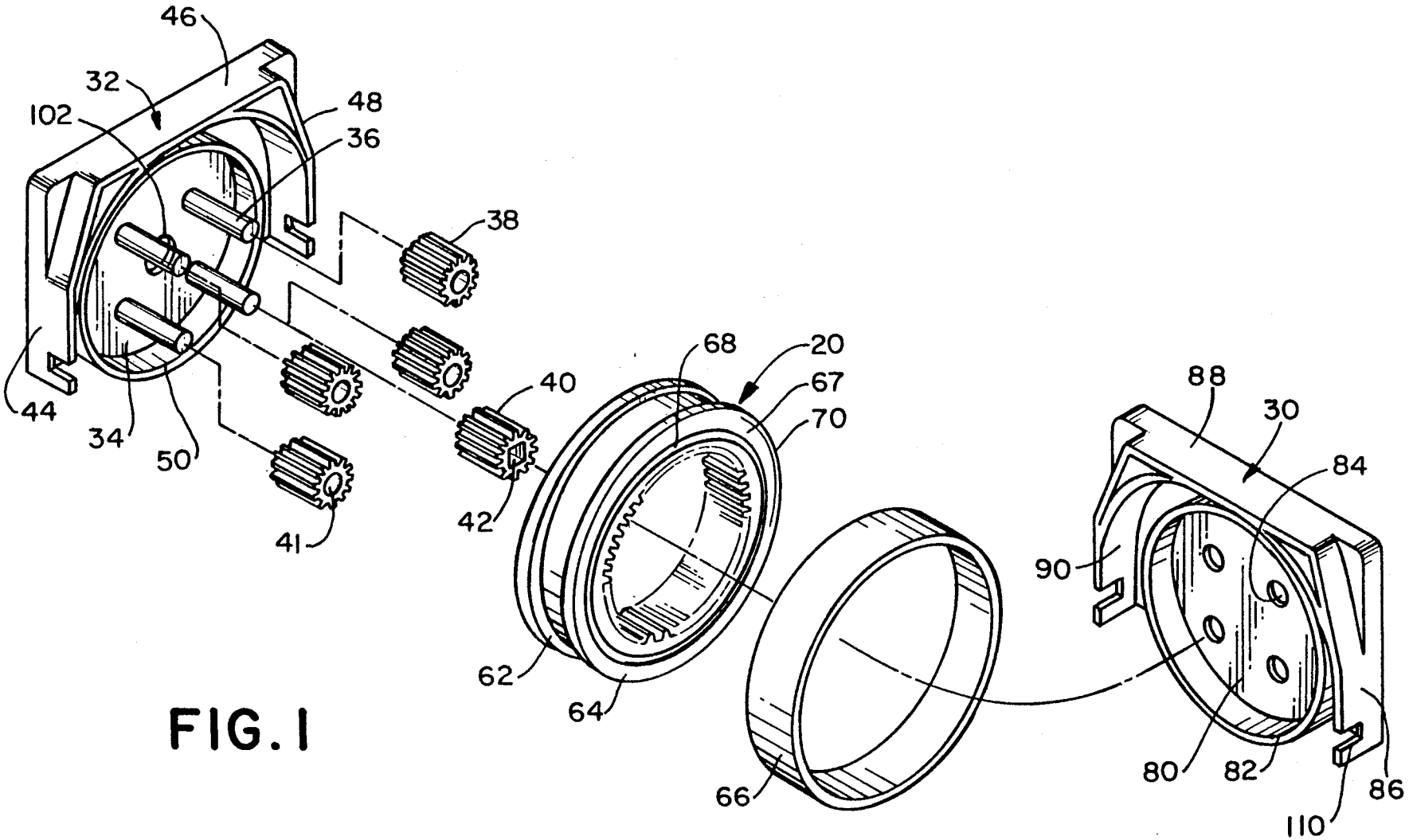
FIG. 1 is an exploded perspective view of a gear cartridge according to a first preferred embodiment of the present invention.

With reference now to FIG. 1, the gear cartridge casing 22 includes a first casing half 30 and a second casing half 32. The second casing half 32 comprises a vertical wall 34 extending from which are a plurality of cylindrical stakes 36 in a direction normal to the vertical wall 34, i.e., in a horizontal direction. Four such spaced stakes are illustrated in FIG. 1 with each of the stakes accommodating a respective planet gear 38 in a rotatable fashion. Disposed between the planet gears and supported only by a gear to gear engagement therewith is a centrally located sun gear 40. It is noted that while the planetary gears each have a circular aperture 41 therethrough to cooperate with a respective one of the cylindrical stakes 36, the sun gear 40 has a square aperture 42 therethrough. The second casing half 32 also comprises a first side wall 44, an upper wall 46 and a second sidewall 48 which together define a somewhat C-shaped wall configuration in relation to the vertical wall 34. Extending in a direction normal to the vertical wall and in a spaced manner around the four stakes 36 is a rim 50. The rim cooperates with the wheel 20.

As is illustrated, the wheel comprises first and second side ribs 62, 64 located on the circumference thereof. The ribs 62, 64 accommodate between them a suitable rubber tread 66 so as to enable the wheel to frictionally engage the ground surface. Located in each side wall 67 of the wheel 20 is a circular slot 68. It should be appreciated that only one of these slots 68 is visible in FIG. 1 although slots are provided on both sides of the wheel 20. The slot 68 is meant to cooperate with the rim 50 provided on the second housing half vertical wall 34. More specifically, the slot 68 and rim 50 cooperate in such a fashion that the wheel 20 is rotatably held by the casing half.

The wheel 20 is toroidal in nature. Extending around an inner periphery of the toroidal wheel is a gear ring 70. The gear ring 70 cooperates with the four planetary gears 38 in a meshing engagement. Therefore, as the wheel 20 rolls on a ground support surface, the gear ring 70 will rotate thereby turning the planet gears 38. These will, in turn, rotate the sun gear 40. It is evident that the rotation of the sun gear will be considerably faster than the rotation of the gear ring 70. Therefore, the rotation of the brush 24 will be considerably faster than the rotation of the wheel 20.

The first casing half 30 also includes a vertical wall 80 which is provided with a normally extending rim 82 that is meant to cooperate with the slot 68 provided on the other side wall of the wheel 20. Engaging through respective apertures 84 located in the vertical wall 80 of the first casing half 30 are the free ends of the stakes 36. In this way, the respective planet gears 38 are trapped on the stakes 36 and prevented from working loose therefrom when the two casing halves 30 and 32 are joined as shown in FIG. 2. Extending around the vertical wall 80 are a first side wall 86, an upper wall 88 and a second side wall 90 of the first casing half 30. When the two casing halves 30 and 32 are mated as in FIG. 2, the wheel 20, the four planet gears 38 and the sun gear 40 are trapped therebetween.

While the preferred embodiment illustrated in FIG. 1 shows the use of four planet gears 38, it should be appreciated that any other suitable number of planet gears such as 3 or 6 could also be utilized if that were desired. The diameters of the planet gears 38 and the diameter of the sun gear 40 are so sized in relation to the gear ring 70 that the sun gear will rotate faster than the gear ring 70, and hence the driving wheel 20, by a pre-selected ratio.

Figure 4:
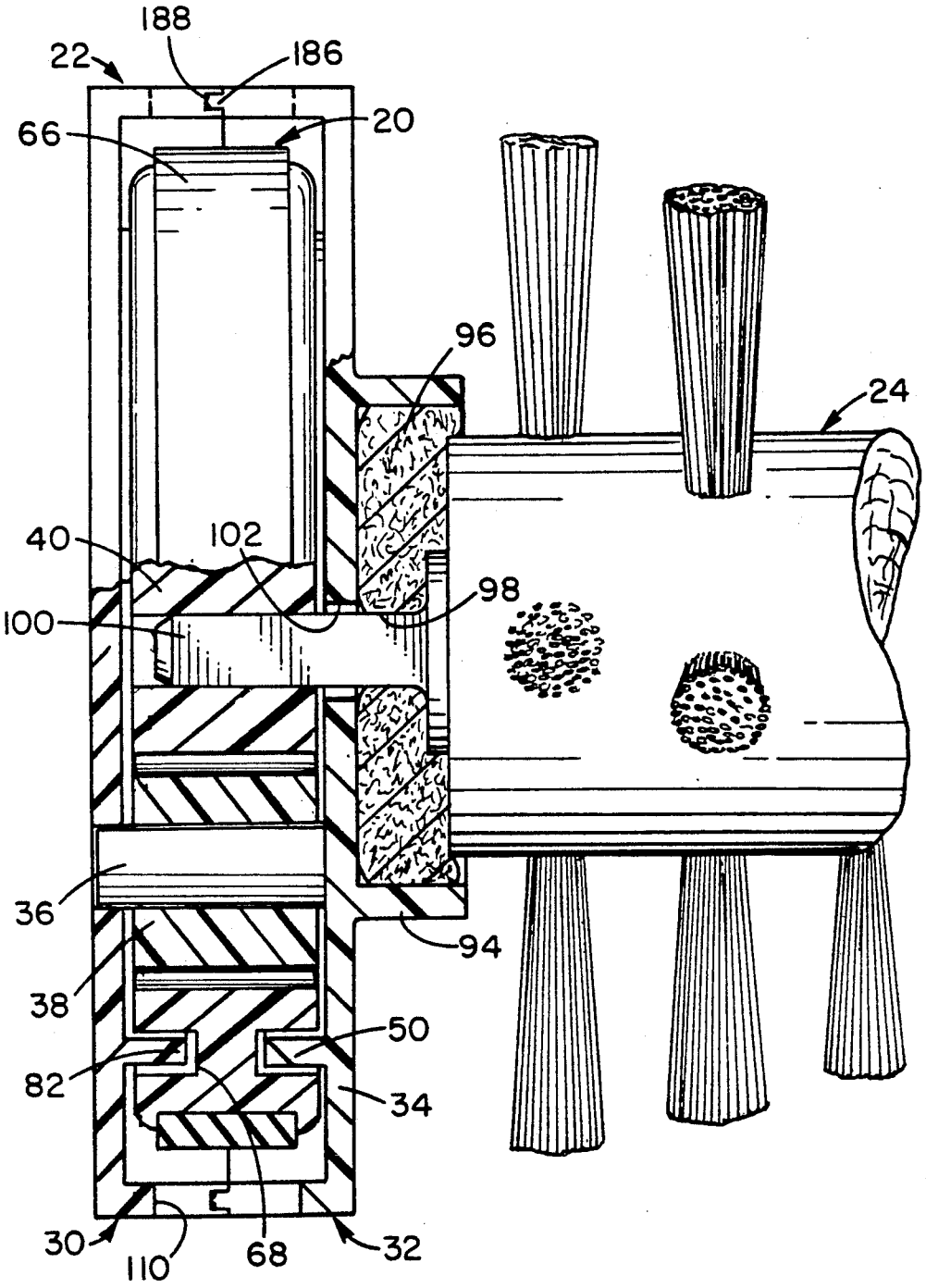
FIG. 4 is an enlarged top plan view, partially in cross-section, of the gear cartridge and brush roll of FIG. 2 in an assembled condition.

With reference now also to FIG. 4, it can be seen that extending from a surface of the vertical wall 34 opposite the surface from which the stakes 36 extend is a dust shield 94. The dust shield can be circular and is adapted to hold one end of the brush roll 24. If desired, a suitable felt washer 96 can be interposed between the end of the brush roll 24 and the wall 34. Extending through an aperture 98 in the washer is a square axle 100 of the brush roll 24. This square axle extends through an aperture 102 in the vertical wall 34 and into the square hole 42 provided in the sun gear 40. In this way, when the sun gear 40 is rotated by the rotation by the planetary gears 38, the sun gear in turn will rotate the brush roll 24. Preferably the casing 22 and the drive wheel 20 are made from a suitable plastic material which can be injection molded to the right configuration, is self-lubricating, and is corrosion free.

It should be appreciated that the wheels 20 float on the planet gears 38 and do not have a single axle around which they rotate. Perhaps the nearest element to an axle in this assembly are the four stakes 36 on which the planetary gears 38 rotate. It is these four stakes which support the whole unit and keep it in place. The function of the ribs 50 and 82 is not that of an axle but is merely to prevent an overtravel of the wheel 20 in the casing halves 30, 32. However, the ribs 50 and 82 also cooperate with the wheel slots 67 and serve as a labyrinth seal to prevent the entry of dust or dirt particles into the gearing assembly.

In the construction outlined hereinabove, a clockwise rotation of the wheel 20 will result in a counter-clockwise rotation of the brush 24. It is believed that a better, more aggressive cleaning action will be obtained by rotating the brush 24 in a direction opposite from the direction in which the wheel rotates.

With reference now again to FIG. 2, the casings 22 each also include a pair of slots 110 defined by the cooperating side walls 44, 86 and 48, 90 of the two casing halves 30 and 32. The slots engage a rib 112 provided on a depending side wall 114 of a housing section 116 extending downwardly from an inner surface of the housing 10. In this regard, preferably the housing 10, and housing section 116 depending therefrom, are both made of a suitable somewhat resilient plastic material. Thus the gear cartridges 22 can be suitably snapped into place in the housings 116 so as to prevent them from becoming dislodged during the operation of the carpet sweeper or floor sweeper A. If desired, the gear cartridges can also include adjacent each upper corner thereof a lead-in 120. These cooperate with the housing section 116 to push the ribs 112 out of the way and assure that the gear cartridge 22 will snap into place in the housing section 116.

As previously mentioned, while FIG. 3 discloses a single brush roll embodiment of the carpet sweeper, FIGS. 5 and 6 disclose a two brush roll embodiment.

More particularly, in accordance with FIG. 5, a gear cartridge 130 includes first and second cartridge casing halves 132 and 134. Extending from the vertical wall 136 of the first casing half are a plurality of first stakes 138. Spaced therefrom are a plurality of second stakes 140. The first stakes rotatably support a plurality of first planet gears 142 while the second stakes rotatably support a plurality of second planet gears 144. Rotatably supported by the first planet gears 138 is a first sun gear 146. Similarly, rotatably supported by the second planet gears is a second sun gear 148. Mounted on a suitable rim (not visible in FIG. 5) is a first wheel 150. Similarly, mounted from a suitable second rim also not visible is a second wheel 152.

Cooperating with the first casing half 132 is a second casing half 134 which includes a vertical wall 160 in which are provided a plurality of first apertures 162 for cooperating with the first set of stakes 138 and a plurality of second apertures 164 for cooperating with the set of second stakes 140. Extending from the vertical wall 136 of the first casing half 132 are a first side wall 162, an upper wall 164 and a second side wall 166. Similarly, extending from the vertical wall 160 of the second casing half 134 are a first side wall 168, an upper wall 170 and a second side wall 172.

Figure 5C:
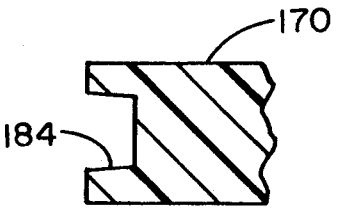
FIG. 5C is a greatly enlarged cross-sectional view of the gear cartridge of FIG. 5A along line 5C—5C.
Figure 5B:
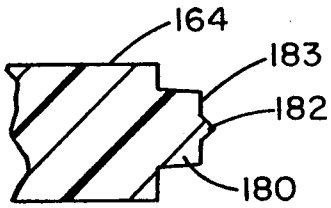
FIG. 5B is a greatly enlarged cross-sectional view of the gear cartridge of FIG. 5A along line 5B—5B.

With reference now also to FIG. 5B, it can be seen that the upper wall 164 is provided with a centrally disposed rib 180. Projecting from the rib is a somewhat V-shaped projection 182. With reference now also to FIG. 5C, the cooperating upper wall 170 of the second casing half 134 includes a slot 184 which is adapted to receive the rib 180 and the projection 182 thereon.

The rib projection 182 extends approximately 0.008" above a front wall 183 of the rib 180. During the securing of the two casing halves 132, 134 to each other, such as by ultrasonic welding, this projection melts and serves to securely lock the rib 180 in the slot 184. This will then secure the two casing halves 132, 134 to each other to insure that the wheels 150, 152 as well as the several gears 142–148 are secured in place. If desired, an adhesive or a solvent may be utilized along with ultrasound during the sealing of the two casing halves 132, 134 to each other. In other words, the rib projection 182 serves as an ultrasonic assembly point and forms the bead which will secure the two casing halves 132, 134 to each other.

It should be appreciated that the identical rib construction is also provided in the casing embodiment of FIGS. 1–4. As best shown in FIG. 4, a rib 186 on the second casing half 132 extends into a slot 188 on the first casing half 130 so as to secure the casing halves to each other when ultrasonic welding or the like is applied. It should be appreciated with regard to the casings of FIGS. 4 and 5, however, that many other ways of securing the casing halves to each other can also be utilized.

As is evident, the gear cartridge illustrated in FIG. 5 is for a two brush roll embodiment of the carpet sweeper of the present invention. As shown in FIG. 6, the gear cartridge 130 can be suitably snapped into place in a housing section 190 depending from a housing 192 of the carpet sweeper B. The housing section 190 is provided with a pair of side walls 194. Extending inwardly from the side walls 194 of the housing section 190 are a pair of ribs 196. These ribs are adapted to cooperate with suitable slots 198 which are defined by the two casing halves 132 and 134. In this way, the gear cartridge 130 can be snapped into place in the housing section 190 and held therein as the carpet sweeper B performs its function. If desired, the cartridge 130 can also be provided with a pair of lead-ins 200, as in the embodiment of FIGS. 1–4. These lead-ins help to slide the gear cartridge 130 into the housing section 190 by moving the ribs 196 out of the way.

It should be evident that the cooperation of the gear casing halves 132 and 134 with the first and second wheels 150 and 152 enable a labyrinth seal to be maintained around the planetary gears 142, 144 and sun gears 146, 148 so as to prevent the accumulation of dirt or dust therein. However, should such dirt or dust penetrate the gear arrangement, the entire gear cartridge 130 can be removed and cleaned or replaced with a new cartridge.

Figure 7:
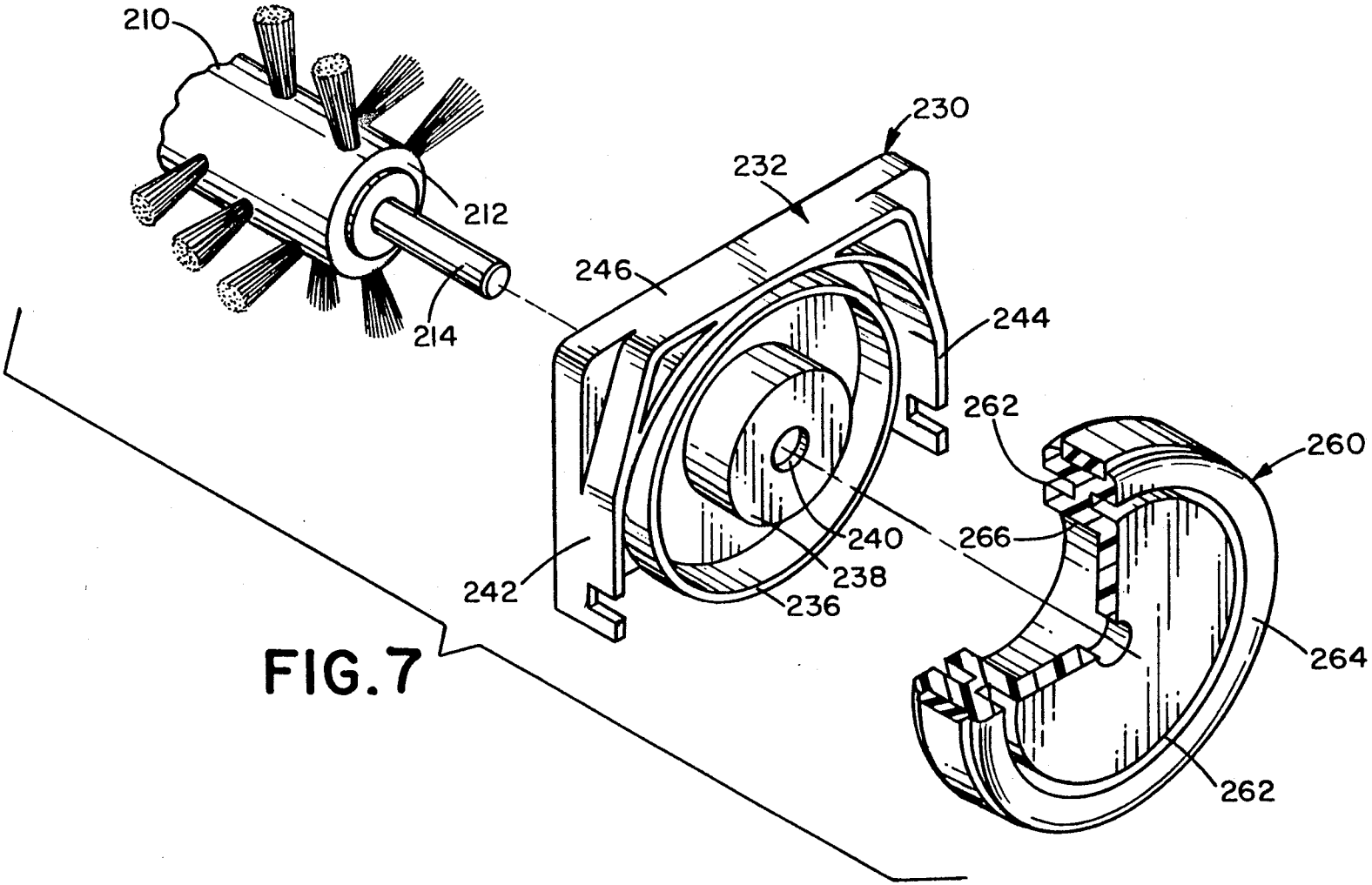

While in the embodiments of FIGS. 1–6, gear cartridges were provided on each end of a brush roll, it is quite conceivable to provide a gear cartridge only on one end of the brush roll with another means being provided for supporting the other end of the brush roll. With reference now to FIG. 7, one such support means for supporting a second end of brush roll is there illustrated. In this embodiment, a brush roll 210 includes an end 212 extending from which is an axle 214. In contrast to the square axles 100 illustrated in e.g. FIG. 2 of the preferred embodiment, which axles are meant to cooperate with suitable square apertures in the sun gear 40 as shown in FIG. 1, the axle 214 is circular. The axle extends into a gear cartridge casing 230 which includes a first casing half 232 and a second casing half (not illustrated). The first casing half 232 has a vertical wall extending from which is a rim 236. Also extending from the vertical wall is a support disc 238. An aperture 240, which is preferably circular and of somewhat larger diameter than the brush axle 214, extends through the center of the support disc 238 so as to accommodate the brush roll axle 214. The casing half also comprises first and second side walls 242 and 244 and a top wall 246. The second casing half similarly includes a rim, first and second side walls and and a top wall. The rims cooperate with a wheel 260, more particularly with circular slots 262 formed in the side walls 264 of the wheel. The wheel 260 is toroidal in nature and includes a large central aperture 266 which is so sized as to accommodate the support disc 238 provided on the first casing half 230. When the two casing halves are closed around the wheel 260, it is constrained to rotate on the support disc 238 while the rims 236, (not shown) fit within the slots 262 on the side walls of the wheel.

As the brush roll 210 is driven from one end (not illustrated in FIG. 7) the other end of the brush roll rotates freely as its axle 214 revolves in the circular aperture 240 of the support disc 238. While one means for supporting a second end of the brush roll 210 in a rotatable manner is disclosed in FIG. 7, it should be evident that other ways of supporting the second end of the brush roll are also known to those of average skill in the art.

Figure 5A:
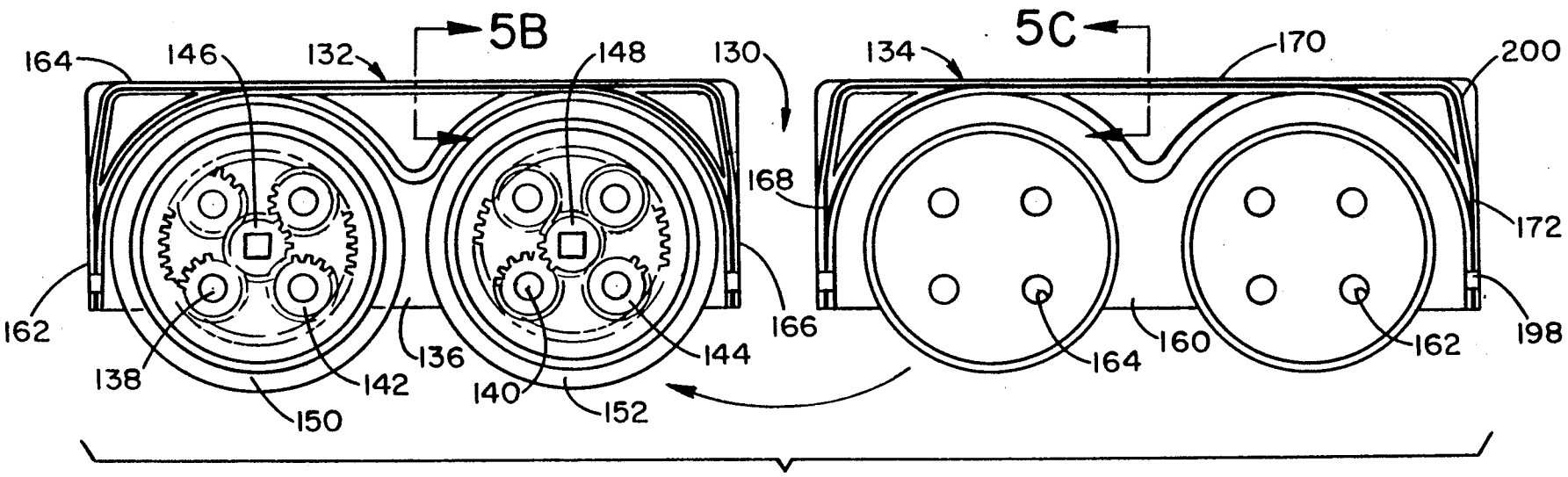
FIG. 5A is a front elevational view of a gear cartridge according to a second preferred embodiment of the present invention.

In the embodiment of FIG. 7, only one such means for supporting is disclosed for supporting one end of a single brush roll. However, as shown in the embodiment of FIG. 5A, it is possible to provide a dual brush roll gear cartridge assembly so as to employ two adjacent brush rolls. For this type of an embodiment, it would be conceivable to provide on the one side of the carpet sweeper housing a first cartridge casing including a first planetary gear assembly and adjacent thereto a first support means and on the other side of the carpet sweeper housing a second cartridge casing including a second support means and adjacent thereto a second planetary gear assembly. Therefore, in this version of the invention, each brush roll would be provided with a planetary gear assembly and a support means with the two support means and the two planetary gear assemblies being located on opposite sides of the housing of the carpet sweeper such that each planetary gear assembly is located adjacent a support means.

The invention has been described with reference to preferred and alternate embodiments. Obviously, modifications and alterations will occur to others upon the reading and understanding of this specification. It is intended that all such modifications and alterations be included insofar as they come within the scope of the appended claims or the equivalents thereof.

Having thus described the invention, it is now claimed as follows:

1. A floor sweeper comprising:
- a housing;
- a brush roll rotatably mounted on said housing;
- a gear cartridge member located on one side of said housing, said gear cartridge member comprising:
- a first planetary gear train including a sun gear coupled to one end of said brush roll, a gear ring encircling said sun gear and a plurality of planet gears engaging both said sun gear and said gear ring,
- a first drive wheel coupled to said gear ring for driving said gear ring and supporting said housing on a subjacent surface, and
- a casing enclosing said first planetary gear train in a sealed manner.

2. The sweeper of claim wherein said casing comprises:
- a first casing half;
- a plurality of stakes extending from and normal to said first casing half, each said stake rotatably supporting one of said planet gears; and,
- a second casing half which mates with said first casing half.

3. The sweeper of claim 2 wherein said casing further comprises a rim extending normal to each said casing half, each of said rims coperating with a groove located on a respective side of said drive wheel to prevent overtravel of said drive wheel in said casing and to provide a labyrinth seal for said gear train.

4. The sweeper of claim 1 wherein said casing further comprises a dust shield which cooperates with an adjacent end of said brush roll to keep dust swept up by said roll from traveling toward said casing.

5. The sweeper of claim 1 wherein said drive wheel comprises a rubber tread portion and means for holding said rubber tread portion on said wheel.

6. The sweeper of claim 1 wherein said casing comprises an upper wall, a pair of side walls and an aperture located on at least one of said side walls, said aperture cooperating with a rib extending from a housing section depending from said housing to secure said casing in place.

7. The sweeper of claim 1 wherein said gear cartridge member further comprises:
- a second planetary gear train, spaced from said first planetary gear train, including a sun gear coupled to said brush roll, a gear ring encircling said sun gear and a plurality of planet gears engaging said sun gear and said gear ring; and,
- a second drive wheel coupled to said gear ring of said second gear train for driving said gear ring and supporting said housing on a subjacent surface, wherein said casing encloses said second planetary gear train.

8. The sweeper of claim 1 further comprising a support means for supporting a second end of said brush roll, said support means being located on an opposite side of said housing from said gear cartridge member.

9. The sweeper of claim 8 wherein said support means comprises:

a wheel housing including a support element for rotatably supporting a second end of said brush roll; and, a support wheel rotatably mounted on said wheel housing.

10. A floor sweeper comprising:

a housing;

a brush roll rotatably mounted at each end to said housing;

a gear cartridge located on a first side of said housing, said gear cartridge member comprising:

at least one planetary gear train including a sun gear rotatably coupled to an end of said brush roll, a gear ring encircling said sun gear and a plurality of planet gears engaging both said sun gear and said gear ring, a drive wheel encircling said gear ring of said at least one planetary gear train and secured thereto, said drive wheel engaging a subjacent ground surface, and a casing enclosing said at least one planetary gear train in a sealed manner wherein said casing comprises:

a first casing half, a plurality of stakes extending from and normal to said first casing half, each said stake rotatably supporting one of said planet gears and, a second casing half which mates with said first casing half.

11. The sweeper of claim 10 wherein said casing further comprises a rim extending normal to each said casing half, each of said rims coperating with a groove located on a respective side of said drive wheel to form a labyrinth seal and prevent dust from entering said gear train.

12. The sweeper of claim 11 wherein said casing further comprises a dust shield which cooperates with an adjacent end of said brush roll to keep dust swept up by said roll from traveling toward said casing.

13. The sweeper of claim 10 further comprising a support means for rotatably supporting a second end of said brush roll, said support means being located on an opposite side of said housing from said gear cartridge member.

14. The sweeper of claim 13 wherein said support means comprises:

a wheel housing including a support element for rotatably supporting a second end of said brush roll; and, a support wheel rotatably mounted on said wheel housing.

15. A floor sweeper comprising:

a housing;

a brush roll rotatably mounted on said housing;

a pair of gear cartridge members located on opposite sides of said housing, each of said gear cartridge members comprising:

a first planetary gear train including a sun gear coupled to a respective end of said brush roll, a ring gear encircling said sun gear and a plurality of planet gears engaging both said sun gear and said ring gear, a first drive wheel coupled to said ring gear for driving said ring gear and supporting said housing on a subjacent surface, and a casing enclosing said first planetary gear train in a sealed manner wherein said casing comprises a pair of casing halves which have mating edges to keep out dirt.

16. The sweeper of claim 15 wherein said casing comprises:

a first casing half;

a plurality of stakes extending from and normal to said first casing half, each said stake rotatably supporting one of said planet gears; and, a second casing half which mates with said first casing half.

17. The sweeper of claim 16 wherein said casing further comprises a rim extending normal to each said casing half, each of said rims coperating with a groove located on a respective side of said drive wheel to rotatably support said drive wheel in said casing.

18. The sweeper of claim 15 wherein said casing further comprises a dust shield which cooperates with an adjacent end of said brush roll to keep dust swept up by said roll from traveling toward said casing.

19. The sweeper of claim 15 wherein said gear cartridge members each further comprise:

a second planetary gear train, spaced from said first planetary gear train, including a sun gear coupled to said brush roll, a ring gear encircling said sun gear and a plurality of planet gears engaging said sun gear and said ring gear; and, a second drive wheel coupled to said ring gear of said second gear train for driving said ring gear and supporting said casing on a subjacent surface, wherein said casing encloses said second planetary gear train.

20. The sweeper of claim 15 wherein said first gear train and said first casing comprise a plastic material.

* * * * *